US005838213A

United States Patent [19]

Huang

[11] Patent Number: 5,838,213

[45] Date of Patent: Nov. 17, 1998

[54] ELECTROMAGNETIC FILTER HAVING SIDE-COUPLED RESONATORS EACH LOCATED IN A PLANE

[75] Inventor: Qiang Huang, Sunnyvale, Calif.

[73] Assignee: Illinois Superconductor Corporation, Mt. Prospect, Ill.

[21] Appl. No.: 714,336

[22] Filed: Sep. 16, 1996

[51] Int. Cl.[6] ..... H01P 1/201

[52] U.S. Cl. ..... 333/99.005; 333/202; 333/219; 333/230; 505/210; 505/866

[58] Field of Search ..... 333/995, 203, 333/219, 219.1, 230, 235, 202, 202 DR, 202 HC; 505/210, 866

[56] References Cited

U.S. PATENT DOCUMENTS

| | | | |
|---|---|---|---|
| 4,757,285 | 7/1988 | Krause | 333/202 X |
| 5,055,809 | 10/1991 | Sagawa et al. | 333/219 |
| 5,329,687 | 7/1994 | Scott et al. | 333/202 X |
| 5,604,472 | 2/1997 | Uppaluri et al. | 333/219 |
| 5,616,540 | 4/1997 | Lithgow et al. | 333/99 S X |
| 5,629,266 | 5/1997 | Lithgow et al. | 333/99 S X |

OTHER PUBLICATIONS

Bonn, Morgan and Hardy, "Split–ring resonators for measuring microwave surface resistance of oxide superconductors," *Rev. Sci. Instrum.*, vol. 62, No. 7, pp. 1819–1823 (Jul. 1991).

Hardy and Whitehead, "Split–ring resonator for use in magnetic resonance from 200–2000 MHz," *Rev. Sci. Instrum.*, vol. 52, No. 2, pp. 213–216 (Feb. 1981).

Mehdizadeh, "An Investigation on Electromagnetic Fields and Properties of the Loop–gap Resonator, a Lumped Mode Microwave Resonant Structure," *A dissertation of Marquette University*, Milwaukee, Wisconsin (1983).

Mehdizadeh, Ishii, Hyde and Froncisz, "Loop–Gap Resonator: A Lumped Mode Microwave Resonant Structure," *IEEE Transactions on Microwave Theroy and Techniques*, vol. MTT–31, No. 12, pp. 1059–1064 (Dec. 1983).

Rinard, Quine, Eaton and Eaton, "Microwave Coupling Structures for Spectroscopy," *Journal of Magnetic Resonance*, Series A 105, pp. 137–144 (1993).

Sakamoto, Hirata and Ono, "Design of a Multicoupled Loop–Gap Resonator Used for Pulse Electron Paramagnetic Resonance Measurements," *IEEE Transactions on Microwave Theory and Techniques*, vol. 43, No. 8, pp. 1840–1847 (Aug. 1995).

*Primary Examiner*—Benny Lee

*Attorney, Agent, or Firm*—Marshall, O'Toole, Gerstein, Murray & Borun

[57] ABSTRACT

An electromagnetic filter includes a plurality of dielectrically-loaded split-ring resonators. The resonators are oriented side-by-side generally within a single plane to achieve side-coupling. The side-coupled orientation of the resonators allows adjacent resonators to be set apart at a distance to achieve electrical coupling. Both the side-coupled orientation of the resonators and the dielectric-loading result in significant volumetric reductions without detrimental decreases in the quality factor of the filter. Coupling screws disposed between adjacent resonators provide further control over the coupling between adjacent resonators.

6 Claims, 3 Drawing Sheets

ELECTROMAGNETIC FILTER HAVING SIDE-COUPLED RESONATORS EACH LOCATED IN A PLANE

FIELD OF THE INVENTION

The present invention relates generally to electromagnetic filters and, more particularly, to the configuration and electromagnetic coupling among resonators in such filters.

BACKGROUND ART

In designing electromagnetic filters, it is desirable to reduce the surface resistance of various components in the filter, such as resonators, in order to increase the quality factor of those resonators and thereby decrease the insertion loss of the filter. Designs using superconductors have been tested and shown to have greatly improved filtering characteristics over resonators using ordinary conductors, such as a significantly higher quality factor. While their increased filtering performance is desirable, superconductors have the drawback of requiring maintenance of an environment around the superconductor below the critical temperature of the superconducting material. For instance, superconductors made from yttrium barium cupric oxides generally must be cooled to 92° K. (−181° C.). Therefore, it is desirable to reduce the overall size of the filter to minimize the volumetric amount that must be maintained below the critical temperature. Even in nonsuperconducting filters, it is usually desirable to minimize volume and thereby decrease cost and space required for the filter.

Prior electromagnetic filters utilizing superconducting components have included multiple split-ring, toroidal resonators disposed in respective parallel planes. In other words, the multiple toroids were generally symmetrical about a common axis. In prior bandpass filters, such a parallel orientation of the resonators developed electromagnetic field strengths that required the resonators to be spaced a certain distance apart in order to achieve an appropriate amount of coupling. This spacing requirement undesirably added to the size of the filter. Furthermore, such a parallel orientation of the resonators mandated that the filter housing be sufficiently deep to accommodate the width of such parallel-oriented resonators while also providing a suitable amount of space between the resonators and the interior walls of the filter housing.

Still further, filters having parallel-oriented resonators may have difficulty achieving elliptical filter performance characteristics because such an orientation may not easily allow for electrical coupling between the resonators. Elliptical filters are generally more desirable than Chebyshev filters due to the ability to achieve steeper filter response skirts with the same or even fewer number of resonators.

SUMMARY OF THE INVENTION

In accordance with one aspect of the present invention, an electromagnetic filter includes a housing having a cavity and a plurality of resonators located in the housing cavity. Each resonator has a respective major curve about a corresponding axis and the respective major curve of each resonator lies in a plane generally orthogonal to each of the corresponding axes.

Adjacent resonators of the electromagnetic filter may be primarily magnetically coupled. Each resonator may be a split-ring resonator having a gap and may be toroidally-shaped. Each resonator may have a respective resonant frequency and have a dielectric partially disposed within the gap of each resonator, respectively, to modify the respective resonant frequency of the resonator.

The electromagnetic filter may have a plurality of coupling screws wherein each coupling screw is respectively disposed between adjacent resonators and is in electromagnetic communication therewith to adjust coupling therebetween. Each coupling screw may generally lie within the plane generally orthogonal to each of the axes of the respective resonators. Each resonator may also have a surface having a superconducting material.

In accordance with another aspect of the present invention, an electromagnetic filter has a filter housing having a pair of end walls and first through third side walls. The electromagnetic filter also has a cover engagable with the filter housing to collectively define an interior cavity. The electromagnetic filter includes a plurality of split-ring resonators, each split-ring resonator having a gap and a respective major curve about a corresponding axis. The respective major curve of each split-ring resonator generally lies in a plane orthogonal to each of the corresponding axes. The plurality of split-ring resonators are disposed in the interior cavity and mounted on the second side wall of the filter housing. The electromagnetic filter further includes a pair of couplers mounted in the pair of end walls, respectively, in electromagnetic communication with the plurality of split-ring resonators. The electromagnetic filter still further includes a plurality of tuners mounted in the first side wall, each tuner extending into the interior cavity near the gap of each split-ring resonator, respectively. The electromagnetic filter also includes a plurality of coupling screws disposed in the first side wall of the filter housing, each coupling screw extending into the interior cavity generally within the plane orthogonal to each of the respective axes of the split-ring resonators and between adjacent split-ring resonators.

Other features and advantages are inherent in the electromagnetic filter claimed and disclosed or will become apparent to those skilled in the art from the following detailed description in conjunction with the accompanying drawing.

DETAILED DESCRIPTION OF THE PREFERRED EMBODIMENT

Figure 1:
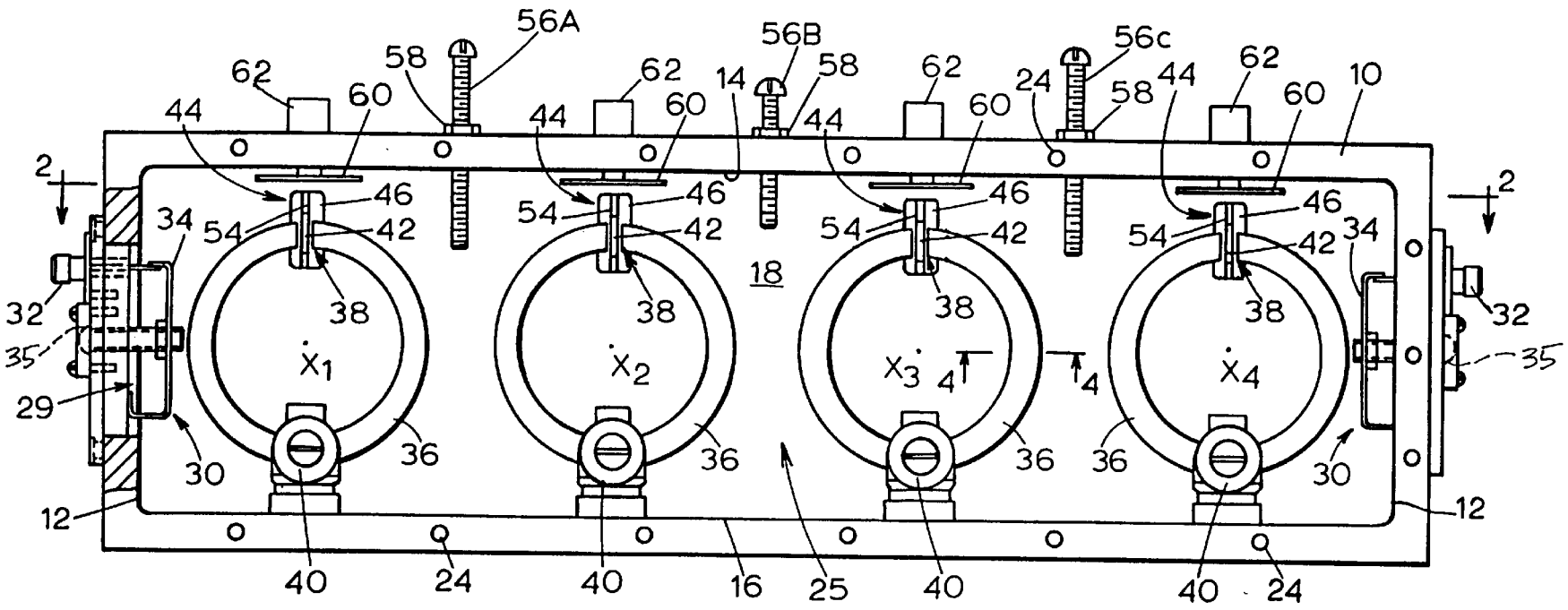
FIG. 1 is a side, elevational view, partially cut-away and partially in phantom, of an embodiment of an electromagnetic filter of the present invention.
Figure 3:
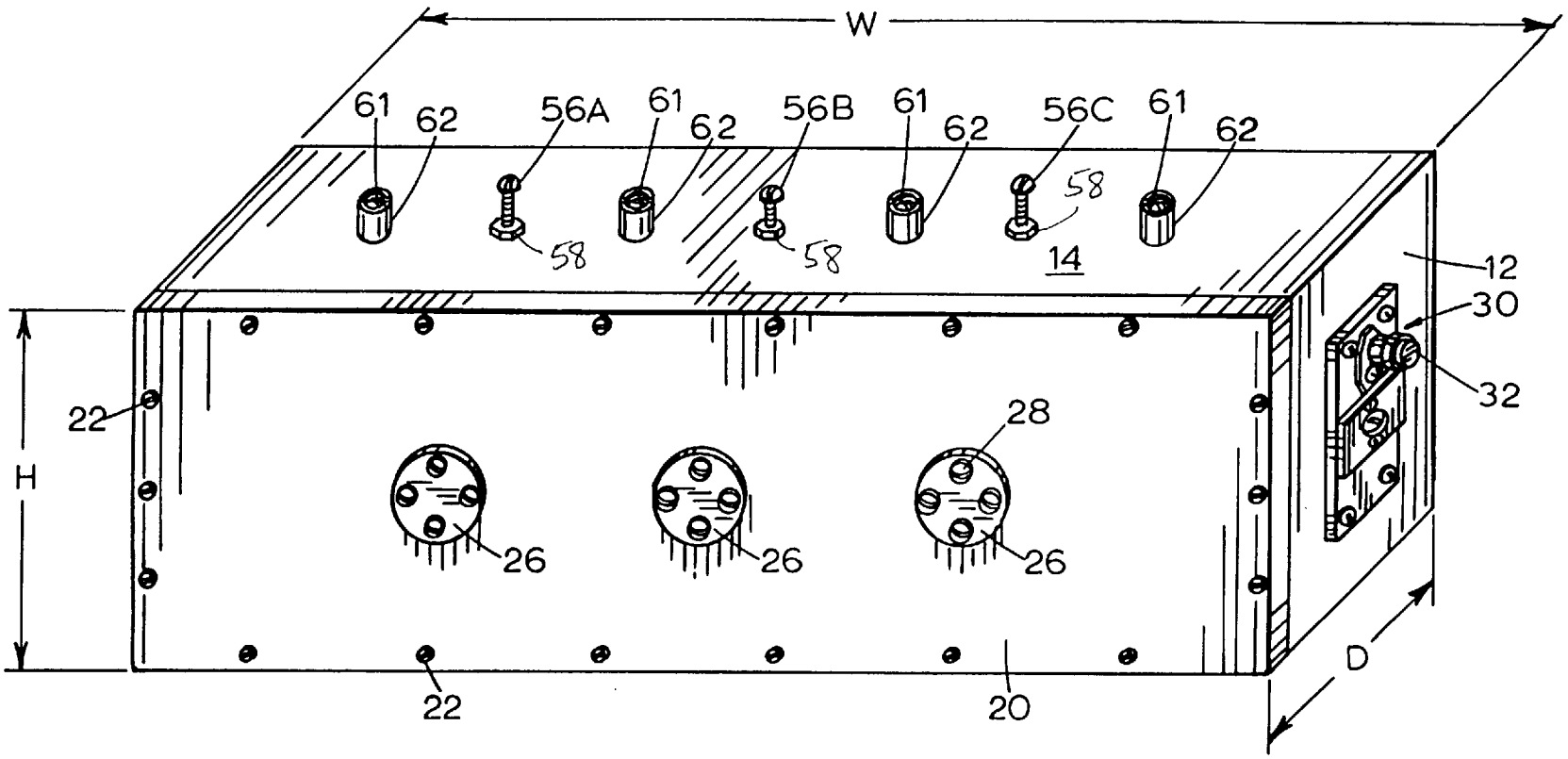
FIG. 3 is a perspective view of a filter housing and cover for the electromagnetic filter of FIG. 1.

Referring initially to FIG. 1, an electromagnetic filter of the present invention includes a filter housing 10 preferably having a pair of end walls 12, upper and lower walls 14 and 16, respectively, and a back wall 18. To completely enclose the filter, a removable cover 20 (FIG. 3) is secured to the filter housing 10 via multiple screws 22 (FIG. 3) threadably engagable with multiple bores 24 in the upper wall 14 and the lower wall 16. The filter housing 10 and removable cover 20 define an interior cavity 25 of the filter. The filter housing 10 and removable cover 20 (FIG. 3) may be composed of a variety of conductors, including silver-plated aluminum or copper. The filter housing 10 could also be constructed of, or coated with, a high temperature superconductor. As shown in FIG. 3, the removable cover 20 includes three circular plates 26 which are secured via multiple screws 28 to the removable cover 20. The three circular plates 26 cover three apertures (not shown) in the removable cover 20 that provide access to the interior cavity 25 (FIG. 1) during operation for measurement or other purposes.

To reduce the cost of cooling incurred by operating the filter 10 at cryogenic temperatures, it is desirable to minimize the volume of the interior cavity 25 and overall size of the filter housing 10. Therefore, a reduction in any one dimension of the filter housing 10 results in a decrease in volume. In the interest of describing such reductions, the dimensions of the filter housing 10 are referred to as follows: width ("W"), height ("H"), and depth ("D"), and are defined as shown in FIG. 3.

As shown in FIG. 1, each of the end walls 12 (see also FIG. 2) includes a rectangular aperture 29 for attaching a pair of couplers 30 (see also FIGS. 2 and 3) (see also FIG. 3), respectively, to the filter housing 10. One of the pair of end walls 12 is shown in FIG. 1 with a portion partially cut-away to depict the insertion of the coupler 30 into the aperture 29. The couplers 30 include a connector 32 (see also FIGS. 2 and 3) (see also FIG. 3), which may be of the conventional co-axial type, for providing an input/output connection to a signal source or other signal processing device (not shown). Each coupler 30 also includes a conductor 34 (see also FIG. 2) that extends into the interior cavity 25 when the coupler 30 is mounted in the end wall 12. The position of the conductor 34, i.e., the extent to which it extends into the interior cavity 25, is adjustable via rotation of a screw 35 (shown partially in phantom). The extent to which the conductor 34 extends into the interior cavity 25 modifies the coupling of the signal to or from a plurality of resonators 36 disposed within the filter housing 10.

Figure 2:
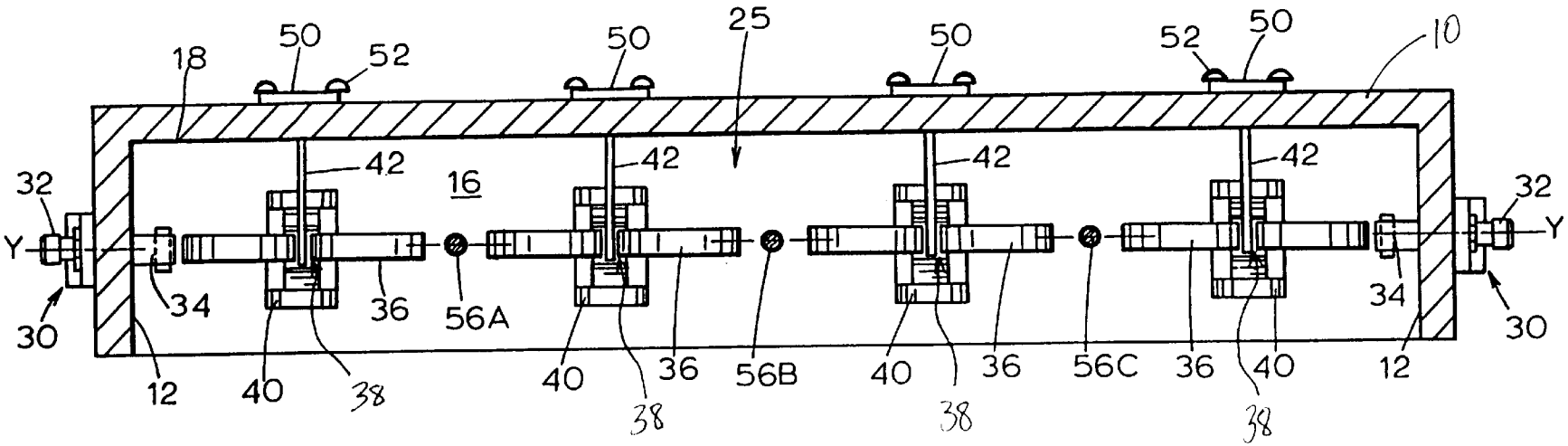
FIG. 2 is a cross-sectional view of the electromagnetic filter of FIG. 1 taken generally along the line 2—2.

Referring now to FIGS. 1 and 2, each resonator 36 is preferably a split-ring resonator having a gap 38. To attain a high quality factor for each resonator 36, each resonator 36 is preferably either composed of, or at least coated with, a superconducting material, but may be composed of copper or silver-plated aluminum. If the resonator is coated with a superconducting material, it may be made in accordance with the teachings of U.S. Pat. No. 5,340,797, which is incorporated herein by reference. Each resonator 36 is mounted on the lower wall 16 of the filter housing 10 with a mounting stand 40 such that the gap 38 is positioned opposite the mounting stand 40. A dielectric slab 42 extends through the gap 38 in each resonator 36 to dielectrically load each resonator 36. The dielectric slab 42 is preferably composed of a material having a high dielectric constant to increase the capacitive self-loading in the gap 38. Increased capacitive self-loading permits decreasing the size of the resonator 36 while maintaining its resonant frequency, which, in turn, permits reductions in the height and width of the filter housing 10. However, to minimize the losses added by the dielectrical loading, a low loss dielectric, such as sapphire, is used for the dielectric slab 42 to keep the quality factor of the filter as high as possible.

Each dielectric slab 42 extends into the interior cavity 25 and the gap 38 of each respective resonator 36 from respective apertures 44 (FIG. 1) in the back wall 18 of the filter housing 10. Each aperture 44 has an insert 46 (FIG. 1) disposed therein. Each insert 46 includes an interior portion for insertion into each respective aperture 44 and an external rim 50 (FIG. 2) having screwholes (not shown) for alignment with threaded screwholes (not shown) in the back wall 18. Thus, multiple screws 52 (FIG. 2) inserted through the screwholes of the external rim 50 threadably engage the threaded screwholes in the back wall 18 to secure each insert 46 to the filter housing 10. The interior portion of each insert 46 further includes a slot 54 (FIG. 1) for insertion of the dielectric slab 42. The dielectric slab 42 is fixed in position by multiple bolts (not shown) that extend through the interior portion of each insert 46 into each slot 54.

Figure 4:
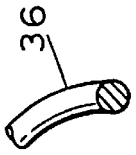
FIG. 4 is a cross-sectional view of a resonator taken along the line 4—4 of FIG. 1.

As shown in FIG. 1, the resonators 36 are curved about central axes $X_1$, $X_2$, $X_3$, $X_4$ respectively. Each resonator 36 is, therefore, symmetrical about its respective central axis $X_1$–$X_1$ with the exception of the gap 38 of each resonator 36. Each resonator 36 preferably has a circular cross-section as seen in FIG. 4. The curve of each resonator 36 about its respective central axis $X_1$–$X_1$ shall be referred to herein as the "major curve" to distinguish from the curve defining the circular cross-section. The resonators 36 are preferably toroidally-shaped as shown in FIGS. 1 and 4 to inhibit current crowding on the superconducting surface of the resonators 36. As best seen in FIG. 2, the resonators 36 are arranged such that each of the respective central axes $X_1$–$X_4$ of the resonators 36 is generally orthogonal to a plane Y. In other words, the major curve of each resonator 36 generally lies within the plane Y such that the resonators 36 are oriented "side-by-side." In this orientation, the resonators are said to be "side-coupled" because the coupling of electromagnetic energy between resonators will be in a direction essentially perpendicular to the respective central axes $X_1$–$X_4$.

The side-coupled orientation of the resonators 36 is significant in several major respects. First, orienting the resonators 36 side-by-side, as described above, decreases the depth of the filter housing 10 because the dimension of the resonators 36 parallel to the respective central axes $X_1$–$X_4$ is small, as shown in FIG. 2, relative to the dimensions orthogonal to the respective central axes $X_1$–$X_4$. Further, the side-coupled resonators 36 develop a weaker magnetic field than the magnetic field generated by the conventional parallel resonator orientation. For that reason, the distance between the resonators 36 can be decreased without resulting in excessive magnetic coupling. For the same reason, less distance is necessary between the couplers 30 and the two nearest resonators 36. The latter two above-identified effects result in a decreased width of the filter housing 10, or at least, a smaller increase of the width which might be necessitated by orientating the resonators 36 side-by-side instead of in a parallel orientation.

The magnetic coupling can be further reduced by decreasing the depth of the filter housing 10, i.e., bringing the back wall 18 and the removable cover 20 closer to the plane Y of the resonators 36. Furthermore, such a depth reduction would result in a desirable decrease in the size of the filter housing 10.

Beyond mere volumetric reductions, adjusting the distance between the side-coupled resonators 36 also permits the filter designer to select a particular coupling mechanism. For example, as the distance between adjacent resonators 36 increases, the magnetic field becomes dominant compared to the electrical field and the coupling, therefore, is said to be "magnetic" (or "positive"). Conversely, as the distance between adjacent resonators 36 decreases, the electrical field becomes dominant and the coupling is said to be "electric" (or "negative"). In a preferred embodiment, the filter is designed such that the distance between adjacent resonators 36 is sufficiently small to achieve magnetic coupling between adjacent resonators, which also conserves additional space.

With reference to FIGS. 1 and 3, modification of the coupling between adjacent resonators 36 is achieved by the adjustment of a plurality of coupling screws 56A, 56B, 56C. Each coupling screw 56A–56C projects into the interior cavity 25 through a respective bore (not shown) in the upper wall 14 which is disposed preferably halfway between two adjacent resonators 36 (i.e., halfway between axes $X_1$ and $X_2$). Each coupling screw 56A–56C is held in a fixed position by a respective nut 58. Preferably, the coupling screws 56A–56C also generally lie within the plane Y (FIG. 2) to maximize their coupling effects. Therefore, for example, adjustments to the amount of the projection of the coupling screw 56A into the interior cavity 25 would adjust the coupling between the two adjacent resonators 36 to either side of the coupling screw 56A, namely, those resonators 36 having respective axes $X_1$ and $X_2$.

Tuning screws similar to the tuning screws 56A–56C would provide coupling adjustment in an alternative embodiment (not shown) wherein each resonator 36 is housed in an individual sub-cavity created by the insertion of a cavity wall between two adjacent resonators. Each cavity wall includes an aperture permitting a limited amount of coupling between such sub-cavities. However, the amount of coupling could be adjusted by use of a tuning screw similar to the tuning screws 56A–56C which could then be inserted into the aperture of the cavity wall.

Referring now to FIG. 1, the tuning of each resonator 36 (i.e., the modification of the resonant frequency of the resonator 36) is accomplished by the projection of a tuning disc 60 towards the gap 38 of each resonator 36. The proximity of the tuning disc 60 to the resonator 36 is modified by the adjustment of a tuner body 61 (FIG. 3) with respect to a tuner bushing 62 (see also FIG. 3). Each tuner bushing 62 is fixedly positioned within a bore in the upper wall 14 of the filter housing 10. The resonant frequency can also be adjusted through the relocation of the dielectric slab 42 within the slot 54 in the clamp insert 46. As shown in FIG. 1, each dielectric slab 42 is centered about the gap 38 of the resonator 36. Movement of the dielectric slab 42 toward the upper wall 14 or lower wall 16 will change the amount of dielectric loading and, thus, change the resonant frequency of the particular resonator 36. Further, as best shown in FIG. 2, the dielectric slab 42 is sufficiently long to extend through the gap 38. However, decreasing the length of the dielectric slab 42 would, in turn, decrease the amount of dielectric loading and, thus, also modify the resonant frequency.

The foregoing detailed description has been given for clearness of understanding only, and no unnecessary limitations should be understood therefrom, as modifications would be obvious to those skilled in the art.

I claim:

1. An electromagnetic filter comprising:

a housing having a cavity therein;

a plurality of toroidally-shaped, split-ring resonators located in the housing cavity wherein each split-ring resonator has a respective major curve about a corresponding axis and the respective major curves of each of the split-ring resonators generally lie in a plane generally orthogonal to each of the corresponding axes;

a plurality of coupling screws;

wherein each coupling screw is respectively disposed between adjacent split-ring resonators of the plurality of split-ring resonators and is in electromagnetic communication therewith to adjust coupling therebetween.

2. The electromagnetic filter of claim 1, wherein each coupling screw generally lies within the plane generally orthogonal to each of the corresponding axes of the respective split-ring resonators.

3. The electromagnetic filter of claim 1, wherein each split-ring resonator includes a respective surface comprising a corresponding superconducting material.

4. An electromagnetic filter comprising:

a filter housing having a pair of end walls and first through third side walls;

a cover engagable with the filter housing to collectively define an interior cavity;

a plurality of split-ring resonators disposed in the interior cavity, each split-ring resonator having a respective gap therein and a respective major curve about a corresponding axis wherein the respective major curves of each of the split-ring resonators generally lie in a plane generally orthogonal to each of the corresponding axes;

a pair of couplers mounted in the pair of end walls, respectively, in electromagnetic communication with the plurality of split-ring resonators;

a plurality of tuners mounted in the first side wall, each tuner extending into the interior cavity near the gap of each split-ring resonator, respectively, to be in electromagnetic communication therewith to adjust a resonant frequency thereof; and a plurality of coupling screws disposed in the first side wall of the filter housing, each coupling screw extending into the interior cavity generally within the plane orthogonal to each of the respective axes of the corresponding split-ring resonators and between adjacent split-ring resonators of the plurality of split-ring resonators to be in electromagnetic communication therewith to adjust coupling therebetween;

wherein the plurality of split-ring resonators are mounted on the second side wall of the filter housing.

5. The electromagnetic filter of claim 4 wherein each split-ring resonator is toroidally shaped.

6. The electromagnetic filter of claim 5, wherein each split-ring resonator includes a respective surface comprising a corresponding superconducting material.

* * * * *

UNITED STATES PATENT AND TRADEMARK OFFICE

CERTIFICATE OF CORRECTION

PATENT NO. : 5,838,213

DATED : November 17, 1998

INVENTOR(S) : Qiang Huang

It is certified that error appears in the above-identified patent and that said Letters Patent is hereby corrected as shown below:

In column 4, line 12 of the patent, delete "$X_1$-$X_1$" and insert --$X_1$-$X_4$ --.

In column 4, line 15 of the patent, delete "$X_1$-$X_1$" and insert --$X_1$-$X_4$ --.

Signed and Sealed this

First Day of June, 1999

*Attest:*

Q. TODD DICKINSON

*Attesting Officer*

*Acting Commissioner of Patents and Trademarks*